United States Patent [19]

Rush et al.

[11] 4,014,380

[45] Mar. 29, 1977

[54] AIR CONDITIONING PROCESS

[75] Inventors: William F. Rush, Arlington Heights; Jaroslav Wurm, N. Riverside; Raymond J. Dufour, Wheaton, all of Ill.

[73] Assignee: Gas Developments Corporation, Chicago, Ill.

[22] Filed: Nov. 4, 1974

[21] Appl. No.: 520,616

Related U.S. Application Data

[63] Continuation-in-part of Ser. No. 415,323, Nov. 13, 1973, Pat. No. 3,889,742.

[52] U.S. Cl. ..... 165/2; 165/7; 165/18; 165/59

[51] Int. Cl.[2] ..... F23L 15/02

[58] Field of Search ..... 165/6, 7, 8, 9, 10, 165/2, 3, 59, 86, 22, 50, 18; 126/420

[56] References Cited

UNITED STATES PATENTS

| | | | |
|---|---|---|---|
| 3,009,684 | 11/1961 | Munters | 165/7 |
| 3,125,157 | 3/1964 | Munters | 165/7 |
| 3,470,708 | 10/1969 | Weil | 62/94 |
| 3,889,742 | 6/1975 | Rush | 165/18 |

*Primary Examiner*—Charles J. Myhre
*Assistant Examiner*—Daniel J. O'Connor
*Attorney, Agent, or Firm*—Thomas W. Speckman

[57] ABSTRACT

A process for open-cycle air conditioning which affords economy of external power both with respect to cost and energy consumption by providing a low-temperature heater and a high-temperature heater for regenerating the sensible heat exchanger and desiccant when the apparatus is used for cooling and the enthalpy exchanger when the apparatus is used for heating. The power source for the low-temperature heater can utilize solar energy, waste boiler heat, waste process heat, nuclear reactor heat and the like. The power source for the high-temperature heater can be an open flame burner or other conventional heater.

9 Claims, 5 Drawing Figures

RECIRCULATING MODE

FULL VENTILATION MODE

NON-SOLAR VS SOLAR & GAS INPUT FOR REGENERATION CYCLE 33
35
42
25
41
40
38
39
36
37
27
22
28
29
30
26
27
31
34
26
23
24
32

AIR CONDITIONING PROCESS

CROSS REFERENCE TO RELATED APPLICATION

This application is a continuation-in-part of our pending application Ser. No. 415,323, filed Nov. 13, 1973 now U.S. Pat. 3,889,742.

This invention relates to air conditioning methods of the open-cycle type. More particularly, this invention relates to improvements in air conditioning methods whereinmoisture and heat are transferred from one air stream to another using elements which move cyclically between the air streams.

Air conditioning apparatus and methods of the open-cycle type are generally disclosed in U.S. Pat. No. 2,723,837, Neal A. Pennington and U.S. Pat. No. 2,926,502, C. G. Munters et al., among others. In such apparatus and methods on air stream to be conditioned passes through an air-permeable drying wheel of a hydroscopic material which absorbs moisture from the air substantially adiabatically. The dried air at an elevated temperature then flows through a rotating heat exchange mass whereby it is cooled by removal of sensible heat. The dried and cooled air is then further cooled to the desired temperature and reconstituted to a desired humidity by evaporating water therein. The hydroscopic material of the drying wheel is cyclically regenerated by a regenerative air stream.

During regeneration, the regenerative air stream is first cooled by evaporative cooling and then passed through the heat exchange mass thereby cooling the latter. Thereafter the regeneration air stream is heated by means of an external heat source to a temperature sufficiently high to regenerate the hygroscopic material of the drying wheel, passed in thermal exchange relation to the hygroscopic material, and then discharged into the atmosphere. Such regeneration means and method are disclosed in U.S. Pat. No. 3,144,901, George W. Meek.

However, utilizing the prior art apparatus and methods a substantial and costly external heat input is necessary for proper completion of the regeneration step. The usual external heat source is an open flame natural gas burner. Especially in view of the present energy crisis it is desirable to minimize external heating requirements and/or to provide means where readily available and relatively inexpensive external energy sources can be advantageously utilized during the operation of this apparatus.

Accordingly, it is an object of this invention to provide a process for air conditioning including cooling and heating wherein the requirements for a high temperature external heat source are lowered.

It is a further object of this invention to provide an improved open-cycle air conditioning method whereby relatively inexpensive, low-temperature heat sources can be utilized to supply a substantial portion of the heat requirement for the regeneration of the hygroscopic material of the moisture transfer means when used for cooling.

It is another object of this invention to provide an open-cycle air conditioning method utilizing relatively inexpensive low-temperature heat sources to supply a substantial portion of the heat requirement for regenerating the enthalpy exchanger when used for heat.

Still other objects within the purview of this invention will readily present themselves to one skilled in the art upon reference to the ensuing specification and the drawings showing preferred embodiments wherein.

Figure 1:
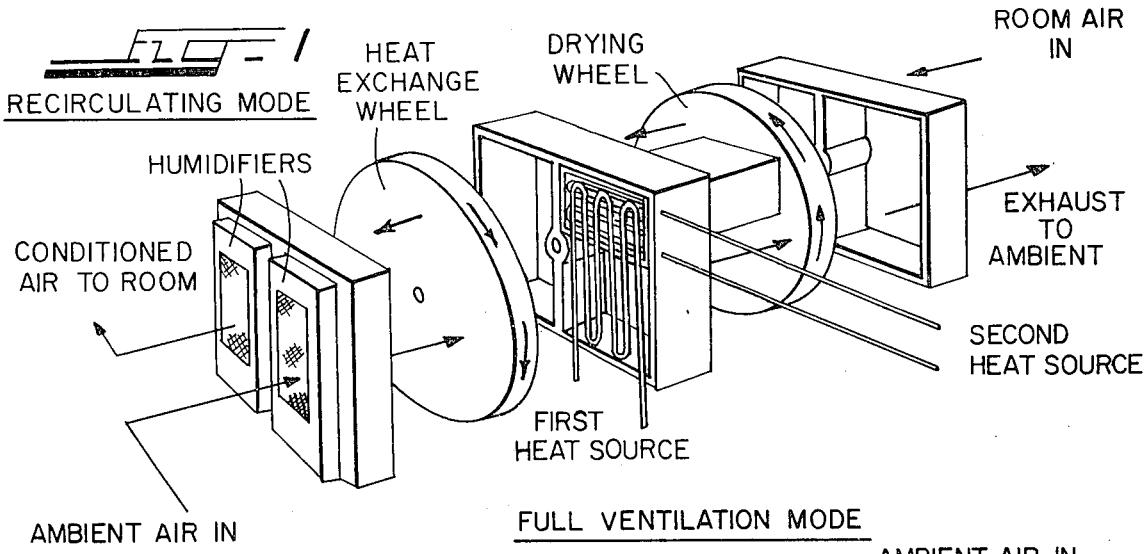
FIG. 1 is a schematic representation of an open-cycle air conditioning apparatus showing one embodiment of this invention for cooling in a full recirculating mode.

The present invention is directed to an air conditioning process which can be operated both in a cooling mode and in a heating mode. An air conditioning apparatus for use in the process of this invention comprises an enclosure which defines an incoming air passageway for air to be treated and a separate regenerative air passageway, means for passing an air stream through each of these passageways, a sensible heat exchanger means within the enclosure and adapted for transfer of thermal energy from one passageway to the other passageway, and desiccant means for transfer of moisture from the air treatment passageway to the regenerative passageway spaced toward the exhaust to the ambient atmosphere of the regenerative air stream. A first evaporative cooling means is provided near the exit port of the conditioned air passageway to the room and a second evaporative cooling means is provided near the entrance port of the regenerative air passageway for use in the cooling mode.

The improvement of this invention comprises a low-temperature heater means situated in the regenerative air passageway between the sensible heat exchanger means and the desiccant means and capable of supplying heat to an air stream flowing within the regenerating air passageway in an amount frequently sufficient to vaporize a major amount of the moisture carried by the desiccant means into the regenerating air passageway. The heat source for the low-temperature heater means can be solar heat, waste heat recovery systems and the like. Any heat source above the temperature of the air being conditioned after exiting the heat exchange wheel is usefull. In the heating mode any heat source above the temperature of the room air is useful. Additionally, a high-temperature heater means may be situated in said regenerating air passageway between the low temperature heater means and the desiccant means which is capable of raising a portion of the heated air stream to a final regeneration temperature for the desiccant.

In the cooling mode of the open-cycle air conditioner, four basic steps are involved: (a) adiabatic drying of a moist air stream to be conditioned by a desiccant means, (b) removal from the conditioning air stream of sensible heat resulting from the adiabatic drying step, (c) adiabatic saturation of the conditioning air stream with water to provide conditioned air having the desired temperature and humidity, and (d) regeneration of the sensible heat exchanger means and desiccant means.

The process of this invention may be operated in the full recirculating mode wherein air from a conditioned room passes through the air treatment passageway and returns to the air conditioned room while ambient air from the atmosphere is passed through the regenerative passageway and exhausted to the ambient atmosphere. The process of this invention may also be operated in the full ventilation mode wherein ambient air from the atmosphere is conditioned for introduction to the room to be conditioned and exhaust air from the conditioned room is utilized as the regenerative air and exhausted to ambient atmosphere. Combinations of the recirculating and ventilation mode may also be utilized. For operation of the apparatus and process in the cooling mode, it is preferred to utilize he recirculating mode of operation while for operation in the heating mode it is preferred to use the ventilating mode of operation. The cooling mode can also be operated under the full ventilating mode or a combination of ventilating and recirculating modes, while the heating mode can be operated at less efficiency under the full recirculating or combination of ventilating and recirculating modes.

For use as a cooling air conditioner, FIG. 1 schematically shows an apparatus for use in the process of this invention in the full recirculating mode. The regenerative air stream is ambient atmospheric air below 120° F. dry bulb and below 95° F. wet bulb. The regenerative air stream enters the apparatus through a humidifier adding moisture to the stream up to the saturation point for the purpose of cooling the incoming air. The moisture saturated regenerative stream is then passed through a heat exchange wheel and heated to about 130° to 200° F. average, under general cooling air conditioning conditions. The heat exchange wheel rotates in the direction shown at from about 2 to about 12 revolutions per minute, about 5 to about 7 rpm being preferred under general cooling conditions. The full regenerative air stream from the heat exchange wheel is passed through the first heat source which may advantageously be at my temperature above the temperature of the regenerative air stream leaving the heat exchange wheel. Therefore, many economical sources are suitable for the first heat source, including heat from solar sources, boiler heat, waste process heat, and the like. After passage through the first heat source, the regenerative air stream is split into two portions, the first portion passing directly through the drying wheel and the second portion passing through a second heat source prior to passage through the drying wheel. The second heat source is at a higher temperature than the first heat source and provides sufficient heat to the second portion of the regenerative stream to regenerate the drying wheel. The final regeneration temperature of the drying wheel is that sufficient to drive off essentially all of the absorbed water of the desiccant on the drying wheel, usually greater than 212° F. and preferably in the order of 212° to 400° F.

The drying wheel rotates in the direction shown at about 1/10 to ½ revolution per minute, preferably about 1/6 to ¼ revolution per minute. The first portion of the regenerative air stream passing through the drying wheel raises the temperature of the desiccant and depending upon its temperature, may drive off adsorbed water, while the second regenerative air stream is of sufficient volume, governed by the angle of exposure of the drying wheel, to regenerate the desiccant at a satisfactory temperature. The regenerative air, after passing through the drying wheel, is exhausted to the ambient atmosphere.

The air stream to be treated, as shown in FIG. 1, is room air, which is adiabatically dried by the drying wheel, passes through the heat exchange wheel where a major portion of the sensible heat is removed, followed by adiabatic saturation with water by a humidifier to provide conditioned air having desired temperature and humidity.

Figure 2:
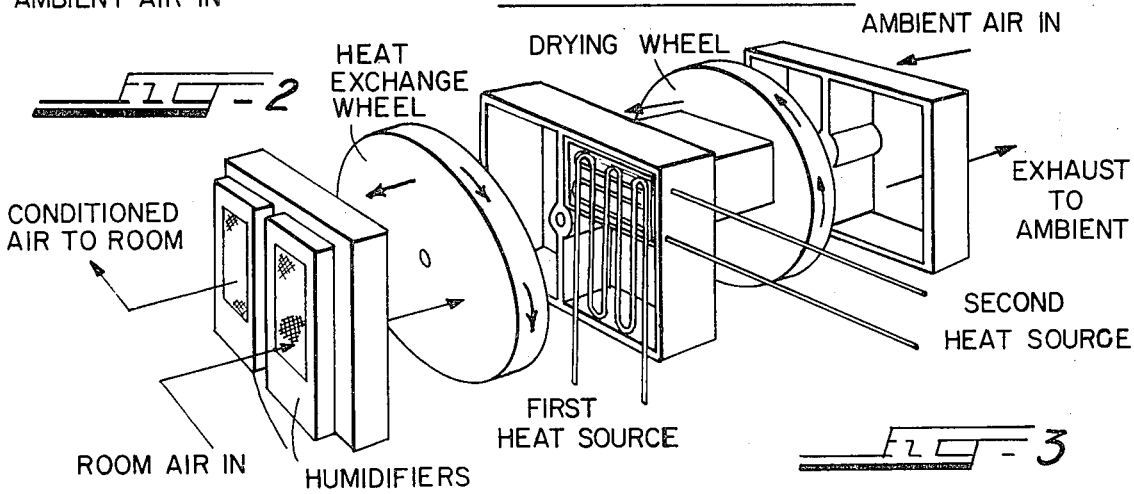
FIG. 2 is a schematic representation of an open-cycle air conditioning apparatus showing one embodiment of this invention for cooling in a full ventilation mode.

FIG. 2 shows an apparatus for use in the process of this invention in the full ventilation mode. The apparatus of FIG. 2 is the same as that of FIG. 1. In the process shown in FIG. 2, the regenerative cycle input is conditioned room air which, after serving as the regenerative stream, is exhausted to the ambient atmosphere and the input for the air stream to be conditioned is from the ambient atmosphere. Otherwise, the operating conditions are similar to the operation of the apparatus of FIG. 1 with differing temperature and humidity conditions.

By way of a specific example of use of the cooling apparatus in a full recirculating mode, as shown in FIG. 1, an air stream from the conditioned room enters the apparatus at 80° F. dry bulb and 67° F. wet bulb (standard American Refrigeration Institute conditions), passes through the drying wheel where it is dried to less than about 0.003 pounds of water per pound of air, raising it in temperature to about 148° F. The treatment stream then passes through the heat exchange wheel wherein it is cooled to about 80° F. and is further cooled by evaporative cooling by passing through a humidifying device and exits from the apparatus to the room at about 56.5° F. dry bulb and about 53° F. wet bulb. Counter-currently with the treatment stream passage, regeneration takes place in the regenerative air passageway where a countercurrent stream is taken from the ambient atmosphere, as shown in the regeneration cycle shown in FIG. 3. All of the air flows are at the rate of 56.1 pounds per minute and the Coefficient of Performance is calculated to be 0.73.

Figure 3:
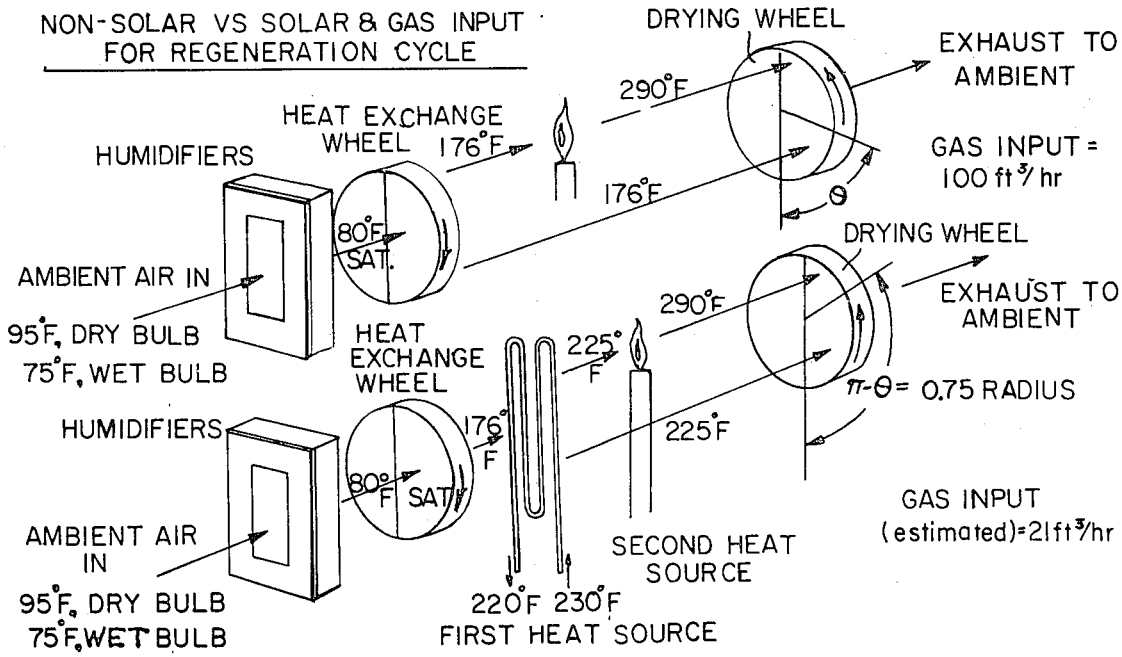
FIG. 3 is a schematic representation showing the comparison of an air conditioning apparatus embodying the present invention utilizing solar heat as a first heat source with open gas flame as a second heat source versus the sole use of an open gas flame as the only heat source.

FIG. 3 shows that for the open-cycle air conditioners operated in the cooling mode prior to this invention, under the above conditions, a gas input of 100 cubic feet per hour was required. Utilizing a first heat source of 230° F., the gas input requirement for the second heat source is reduced to a total gas input (estimated) of 21 cubic feet per hour, almost one-fifth of the former gas input requirement. The first heat source raises the temperature of the preheated sector of the drying wheel in FIG. 3 to a temperature sufficiently high to accomplish, frequently, a major portion of the regeneration. This reduces the sector of the drying wheel through which the air heated by the second heat source passes. Utilization of the apparatus for cooling under full ventilation mode, as shown in FIG. 2, reduces the Coefficient of Performance somewhat, dependent upon ambient temperature conditions and room exhaust temperature conditions. For these reasons, it may be preferred to use the recirculating mode as diagramatically shown in FIG. 1 when the apparatus is used to cool air, but combination of the recirculating and ventilation mode may be desirable to provide freash air to the conditioned room.

With regard to the construction of the various elements of the air conditioning apparatus embodying the present invention, the drying wheel is preferably a rotating wheel made of a corrugated asbestos sheet and impregnated with a hygroscopic substance such a lithium chloride, silica gel, crystalline aluminosilicates (molecular sieves), and similar substances. The corrugated sheet is then wrapped around a mandrel and wound into wheel shape to form a disc comprising a plurality of parallel channels which permit rapid drying of an air stream flowing therethrough and regeneration. Typical lithium chloride desiccant wheels are disclosed in U.S. Pat. No. 2,700,537, Neal A. Pennington.

A particularly preferred desiccant wheel, having an amount of desiccant on the support of up to about 90%, comprises sheets or layers of a fibrous material such as asbestos impregnated with about 25 to about 90 percent by weight of finely-divided crystalline alkali metal or alkaline earth metal aluminosilicates having a pore size of about 3 Angstroms to about 13 Angstroms. Asbestos or other fibrous materials may be combined with the aluminosilicates by forming an aqueous slurry of asbestos fibers and the desired amount of an aluminosilicate, depositing the slurry on a continuously moving screen, and then drying the slurry while on the screen so as to form a thin sheet which is rolled to form a wheel in a manner hereinabove set forth. Such aluminosilicate wheels have been found to reduce the moisture of the air stream to less than 0.003 pounds of water per pound of air under the most rigorous conditions of temperature and humidity found in the United States. The use of aluminosilicate wheels is more fully described in U.S. Pat. No. 3,844,737, Desiccant System for an Open-Cycle Air Conditioning System.

The heat exchange wheel is preferably a wheel of substantially the same diameter as the desiccant wheel. The heat exchanger wheel can be made of expanded aluminum honeycomb, aluminum foil, fibrous materials such as asbestos coated with a hydrophobic material, or the like, which permits the passage of an air stream with very little pressure drop thereacross yet which presents a large heat exchange area.

The evaporative cooling means may be pads made from cooling tower fill such as corrugated paper sheets impregnated with a suitable bactericide, e.g., phenolic resin. The pads are positioned vertically and water from a reservoir pan situated below the pads is recirculated thereover. As the water runs down the pad by gravity, an air stream passes in a tortuous path through the pad and becomes humidified.

The first heater or low-temperature heater means may be a heat-exchange coil through which a suitable heat transfer fluid is circulated. The external heat source for raising the heat transfer fluid to a desired temperature can be solar heat, waste heat from another unrelated operation, heat generated by a nuclear reactor, electrically generated heat, or the like.

The second heater or high-temperature heater means conveniently can be an open flame burner or it can be another heat exchange coil within which a heat transfer fluid is circulated at a relatively high temperature so that the portion of air stream passing over this heat exchange coil can be heated to the necessary final regeneration temperature.

Not shown in the figures is a suitable fan means to move both the treatment air stream and the regenerative air stream through the apparatus.

Baffle means, preferably adjustable, are necessary to conduct the second high temperature portion of the regenerative air stream through the second heat source and to the necessary sector of the drying wheel.

Figure 5:
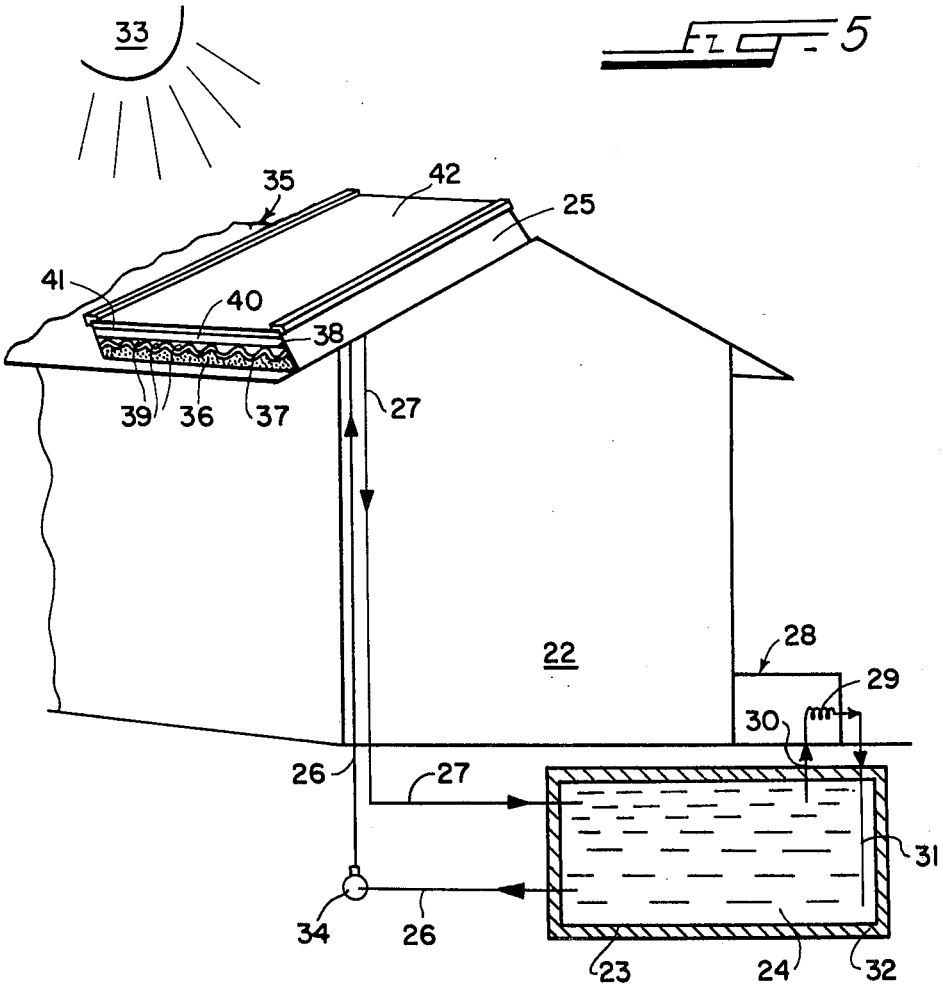
FIG. 5 is a schematic representation showing use of solar heat to one embodiment of this invention.

The present invention is very well suited for use in combination with a solar heat source which provides heat input to the low-temperature heater means for both cooling and heating. A particularly preferred air conditioning system embodying the present invention and utilizing solar heat is illustrated in FIG. 5. Enclosed space such as home 22 is provided with solar energy storage tank 23 containing heat transfer fluid 24, solar energy collector means 25 and conduits 26 and 27 which provide communication between collector means 25 and tank 23. Home 22 is heated or cooled, as desired, by air conditioning apparatus 28 which is of the general type shown in FIG. 1. Heater means in open-cycle air conditioning apparatus 28 comprises heat exchange coil 29 (equivalent to first heat source in FIGS. 1 and 2) through which heat transfer fluid 24, e.g., water, water-ethylene glycol mixtures, or the like, is circulated via conduits 30 and 31. Heat loss from tank 23 is minimized by means of insulating layer 32 which surrounds tank 23. In operation of this solar energy recovery system radiant solar heat from source 33, the sun, is utilized to raise the temperature of heat transfer liquid 24 in tank 23. Liquid 24 is circulated by means of pump 34 via conduit 26 from tank 23 up to and through solar collector means 25 situated on roof 35, and then returned to tank 23 at a relatively higher temperature. Pump 34 is operated only during times at which the solar transfer fluid in the collector means 25 is at a temperature higher than the temperature of the heat transfer liquid 24 at the upper portion of tank 23. For operating the low-temperature heater means of air conditioning apparatus 28, relatively hotter heat transfer fluid is withdrawn from tank 23 via conduit 30 at an upper level and relatively colder heat transfer fluid is returned to tank 23 via conduit 31 or a lower level thereof.

Solar energy collectors suitable for use in the system embodying the present invention can be of two general types: (1) concentrating type, or (2) non-concentrating type.

The concentrating type solar energy collector is capable of developing higher temperatures by concentrating the radiation emanating from the sun and to achieve a relatively higher collector efficiency by using a smaller heat absorption area with attendant smaller heat losses. However, the concentrating type of collector must be the beam radiation component of sunlight, thus there can be no heat collection on cloudy days. Moreover, the mirrors and/or lenses that follow the beam radiation component of sunlight are guided by a relatively complex and costly tracking system.

Figure 4:
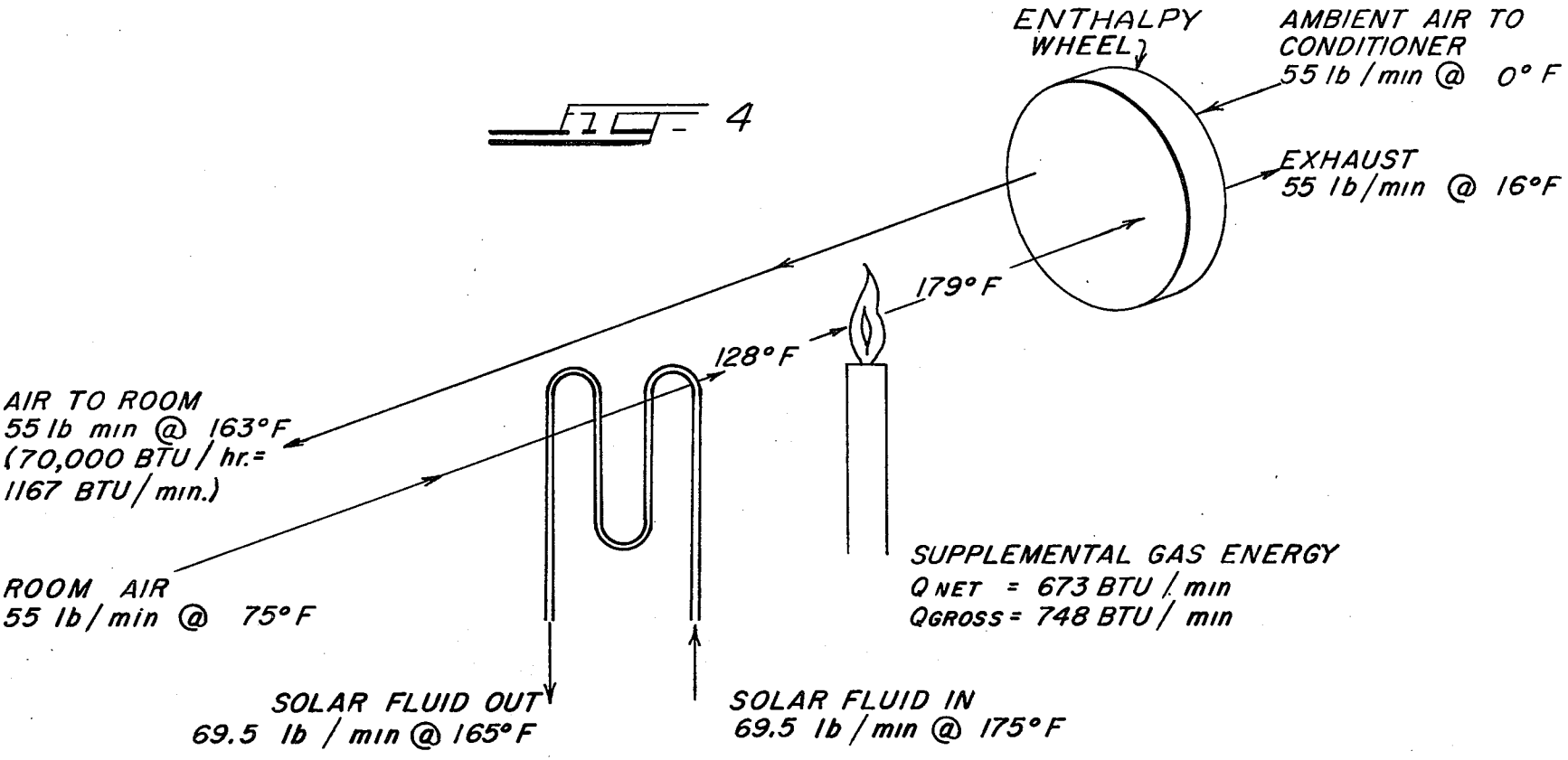
FIG. 4 is a schematic representation of an open-cycle air conditioning apparatus showing one embodiment of this invention for heating in full ventilation mode.

The non-concentrating solar collectors collect both the beam and the diffuse radiation components of sunlight, and are operable on cloudy or overcast days as well. They are less costly and no tracking system are required. Nevertheless, heat transfer liquid temperatures as high as about 230° F. are readily achievable, which temperatures are sufficiently high for the present purposes. A suitable non-concentrating solar collector is shown in FIG. 4.

Collector 25 comprises insulated base 36 on which is placed a sandwich comprising corrugated aluminum plate 3 and flat aluminum plate 38, together defining a plurality of passageways 39 through which a heat transfer fluid is circulated. The exposed face 40 of plate 39 may be coated with a selective coating which reduces infrared emission from the collector surface. Spaced transparent cover sheets 41 and 42 are situated over exposed face 40 to reduce convective heat losses as well as to provide protection from the elements, windblown debris, and the like. A polyvinyl fluoride film, glass or the like, reinforced with a wire or fabric mesh is suitable for this purpose.

Any type of solar collector which will raise the temperature of the heat transfer fluid to over about 180° to 200° F. is suitable for use in this invention. Likewise, any other heat sources which can provide such temperatures are suitable, such as waste heat from any boiler or chemical process source.

The storage for the heat transfer fluid may be any suitable material, shape and size compatible with the fluid. For example, compartmentalized tanks may be used.

The apparatus as process of this invention can also be operated in a heating mode, providing higher heating efficiency than a conventional gas-fired furnace. In a typical heating mode, the heat exchange wheel is stationary and the rotational speed of the drying wheel is increased to about 2 to about 12 rpm, preferably about 5 to about 7 rpm. At the increased rotational speed this wheel behaves as an enthalpy exchanger, exchanging heat and moisture. The air stream, previously characterized as "treatment air stream" in FIG. 2 heats ambient air by passing through the drying wheel, now functioning as an enthalpy exchanger, sufficiently for discharge as conditioned air to the room. The regeneration air stream is heated by the first heat source and a portion by the second heat source to a temperature sufficient to regenerate the enthalpy exchanger both with respect to temperature and moisture. A major portion of the sensible heat imparted to the enthalpy exchanger is removed by the incoming treatment air stream which passes through the heated and regenerated portion of the enthalpy exchanger wheel. In addition, moisture removal from the incoming air stream by the desiccant further raises its temperature. The net effect is that the air stream exhausted from the regeneration air passageway to the ambient atmosphere may be at a temperature only about 20° F. higher than ambient. Thus, air stream enthalpy that is being discarded is substantially less than that wasted in the conventional gas-fired furnace where flue gases usually have a temperature of about 400° to about 500° F.

An example of a process of this invention using the apparatus shown in FIG. 2 and following the schematic representation shown in FIG. 4 in the heating mode is the supplying of conditioned air at about 55 pounds per minute at a temperature of about 163° F., when the ambient temperature is 0° F. and 70,000 BTU/hr. must be supplied to the conditioned volume at a steady state. Room air at about 75° F. is supplied to the regeneration air passageway and heat is supplied to the regeneration air passageway by heat transfer liquid at about 175° F. from a solar energy storage tank circulated through the first heat source at 69.5 pounds per minute, leaving the coil at about 165° F. The regeneration air stream passing over the first heat source is heated to about 128° F. and further heated by an open flame gas burner used as the second heat source to about 179° F. and then passed through the enthalpy exchanger rotating at about 5 rpm. The heat input to the second heat source, the gas burner, is about 673 BTU/min. The open gas flame adds moisture to the stream, but it may be desirable to add additional moisture to the treated steam prior to introduction into the room. This may be done by any conventional means such as evaporator pads. The exhaust air leaving the regeneration air passageway to the ambient atmosphere is at about 16° F. The enthalpy exchanger revolves and the incoming treatment air stream at about 0° F. passes through the enthalpy exchanger both heating the stream and drying the stream adiabatically, the combination raising the temperature of the treatment stream to about 163° F. for discharge to the conditioned room. Thus, with a direct fossil fuel net input of 673 BTU/min., a heat input to the conditioned room of 1167 BTU/min. can be achieved. By contrast, a gas furnace operating at conventional 70% efficiency requires about 1167 BTU/min. fossil fuel consumption to provide the conditioned room air input of 1167 BTU/min.

The process for cooling according to this invention comprises the steps of adiabatically drying a moist air stream to be conditioned by a disiccant means; removing from the conditioning air stream sensible heat resulting from the adiabatic drying; saturated adiabatically the conditioning air stream with water to provide conditioned air having desired temperature and humidity; and regenerating the sensible heat exchanger means and the desiccant means with a regeneration stream wherein the entire regeneration stream passing from the heat exchange wheel passes a low-temperature heat source and a portion of the regeneration air stream from the low temperature heat source passes a high-temperature heat source and passes said desiccant means at a sufficient temperature to regenerate said desiccant means.

The process for heating, according to this invention, comprises the steps of passing an air stream over an enthalpy exchanger heating the air for introduction to a conditioned space and regenerating the enthalpy exchanger with a regeneration stream of air wherein the entire regeneration stream passes a low-temperature heat source and a portion of the regeneration air stream from the low-temperature heat source passes a high-temperature heat source and passes said enthalpy exchanger at a sufficient temperature to regenerate said enthalpy exchanger both with respect to temperature and moisture.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An open-cycle air conditioning process for cooling air wherein air to be cooled is passed through a treatment passageway and a regeneration air stream is passed through a separate regenerative air passageway comprising the steps:

passing air to be cooled through a treatment air passageway and in sequence adiabatically drying the treatment stream by a desiccant means, transferring sensible heat resulting from the adiabatic drying by a sensible heat exchanger means for the treatment air stream to the regeneration air stream and evaporatively cooling the treatment air stream with water to provide conditioned air having desired temperature and humidity; and passing a regenerative air stream through a separate regenerative air passageway countercurrent to said treatment air stream and in sequence regenerating said sensible heat exchanger means by absorbing heat in the regenerative air stream, the entire regenerative air stream from said heat exchanger means being further heated by passing a low temperature heater means between said sensible heat exchanger means and said desiccant means supplying heat to the entire regenerative air stream, splitting said regenerative air stream into a first and a second portion, said first portion passing directly through a segment of said desiccant means to partially regenerate said segment and said second portion being further heated by passing a high temperature heater means and than passing said second portion through the segment of said desiccant means partially regenerated by said first stream at a sufficient temperature to complete regeneration of said desiccant means segment.

2. The process of claim 1 wherein said treatment air stream is recirculated from the conditioned space and said regeneration stream is from the ambient atmosphere.

3. The process of claim 2 wherein said low-temperature heat source is provided heat from a source selected from solar sources, waste boiler heat, waste process heat and nuclear reactor heat.

4. The process of claim 3 wherein said heat source is provided heat from a solar energy source.

5. The process of claim 1 wherein said treatment air stream is from the ambient atmosphere and said regeneration stream is recirculated from the conditioned space.

6. The process of claim 1 wherein a portion of said treatment air stream is from the ambient atmosphere and a portion is recirculated from the conditioned space.

7. The process of claim 1 wherein a portion of said regeneration stream is from the ambient atmosphere and a portion recirculated from the conditioned space.

8. Te process of claim 1 wherein said low-temperature heat source is provided heat from a source selected from solar sources, waste boiler heat, waste process heat and nuclear reactor heat.

9. The process of claim 8 wherein said heat source is provided heat from a solar energy source.

* * * * *